US008639153B2

(12) United States Patent
Suto

(10) Patent No.: US 8,639,153 B2
(45) Date of Patent: Jan. 28, 2014

(54) CLEANING BODY INCLUDING ELASTIC LAYER, CLEANING DEVICE, CHARGING DEVICE, ASSEMBLY, AND IMAGE FORMING DEVICE

(75) Inventor: Masaki Suto, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 319 days.

(21) Appl. No.: 12/899,254

(22) Filed: Oct. 6, 2010

(65) Prior Publication Data

US 2011/0170900 A1 Jul. 14, 2011

(30) Foreign Application Priority Data

Jan. 13, 2010 (JP) ..... 2010-005264

(51) Int. Cl.
*G03G 15/00* (2006.01)

(52) U.S. Cl.
USPC ..... 399/100

(58) Field of Classification Search
USPC ..... 399/100, 353, 354, 355
See application file for complete search history.

(56) References Cited

U.S. PATENT DOCUMENTS 3,056,987 A * 10/1962 Rifkin et al. ..... 15/210.1
3,076,989 A * 2/1963 Daw ..... 15/192
5,398,102 A 3/1995 Wada et al.
2004/0213597 A1* 10/2004 Yanagida et al. ..... 399/100
2006/0270541 A1 11/2006 Narita et al.

FOREIGN PATENT DOCUMENTS

| | | | |
|---|---|---|---|
| JP | 56161576 A | * | 12/1981 |
| JP | S63-200864 U | | 12/1988 |
| JP | 05-142920 A | | 6/1993 |
| JP | 05-297686 A | | 11/1993 |
| JP | 08095393 A | * | 4/1996 |
| JP | 08-137208 A | | 5/1996 |
| JP | 2002-091134 A | | 3/2002 |
| JP | 2006-330483 A | | 12/2006 |
| JP | 2008-070532 A | | 3/2008 |
| JP | 2008-145566 A | | 6/2008 |
| JP | 2008-304729 A | | 12/2008 |

OTHER PUBLICATIONS

Japanese Office Action dated Nov. 5, 2013 and English translation of the Japanese Office Action.

* cited by examiner

*Primary Examiner* — Quana M Grainger
(74) *Attorney, Agent, or Firm* — Sughrue Mion, PLLC

(57) ABSTRACT

A cleaning body has: a shaft; a cleaning member that is spirally wound around the shaft, and that has an elastic layer and an adhesive layer whose obverse is adhered to the elastic layer and whose reverse is adhered to the shaft; and a contacting member that is provided at least one end portion in an axial direction of the shaft, and that contacts the adhesive layer at a position away from an circumferential surface of the shaft. The cleaning body causes the elastic layer to contact a body to be cleaned, and cleans a body to be cleaned.

15 Claims, 15 Drawing Sheets

CLEANING BODY INCLUDING ELASTIC LAYER, CLEANING DEVICE, CHARGING DEVICE, ASSEMBLY, AND IMAGE FORMING DEVICE

CROSS-REFERENCE TO RELATED APPLICATION

This application is based on and claims priority under 35 USC 119 from Japanese Patent Application No. 2010-5264 filed on Jan. 13, 2010.

BACKGROUND

Technical Field

The present invention relates to a cleaning body, a cleaning device, a charging device, an assembly, and an image forming device.

SUMMARY

A first aspect of the present invention is a cleaning body having: a shaft; a cleaning member that is spirally wound around the shaft, and that has an elastic layer and an adhesive layer whose obverse is adhered to the elastic layer and whose reverse is adhered to the shaft; and a contacting member that is provided at least one end portion in an axial direction of the shaft, and that contacts the adhesive layer at a position away from an circumferential surface of the shaft.

BRIEF DESCRIPTION OF THE DRAWINGS

Exemplary embodiments of the present invention will be described in detail based on the following figures, wherein.

DETAILED DESCRIPTION

An example of an exemplary embodiment relating to the present invention is described hereinafter on the basis of the drawings.

Figure 1:
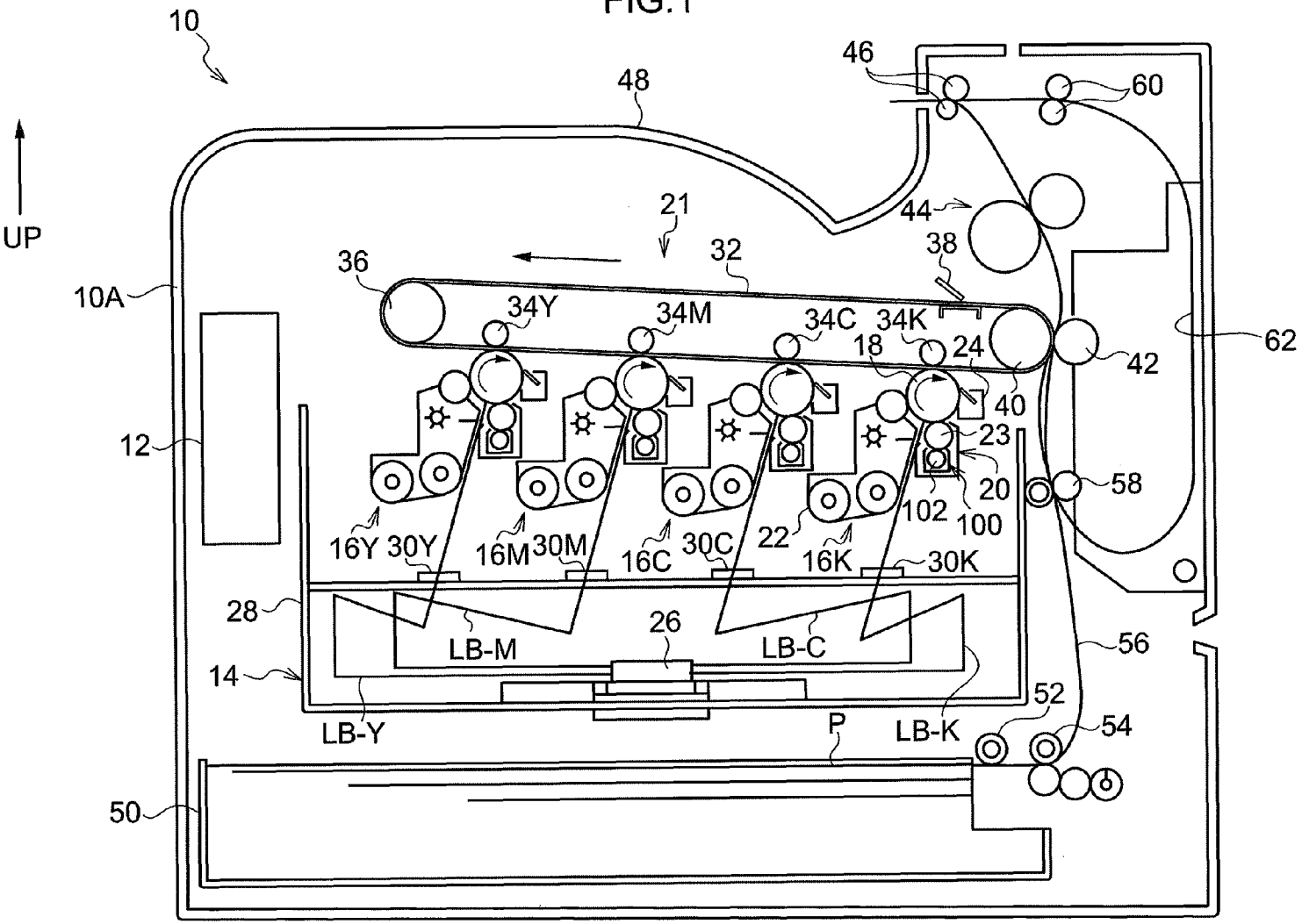
FIG. 1 is a schematic drawing showing the structure of an image forming device relating to an exemplary embodiment.

Structure of Image Forming Device Relating to the Present Exemplary Embodiment First, the structure of an image forming device relating to the present exemplary embodiment will be described. FIG. 1 is a schematic drawing showing the structure of the image forming device relating to the present exemplary embodiment. Note that arrow UP shown in the drawings indicates the vertically upward direction.

As shown in FIG. 1, an image processing section 12, that carries out image processings on inputted image data, is provided within a device main body 10A of an image forming device 10.

The image processing section 12 processes inputted image data into gradation data of the four colors of yellow (Y), magenta (M), cyan (C), black (K). An exposure device 14, that receives the processed gradation data and carries out image exposure by laser lights LB, is provided in the center of the device main body 10A.

Four image forming units 16Y, 16M, 16C, 16K of yellow (Y), magenta (M), cyan (C), black (K) are disposed at uniform intervals in the horizontal direction, above the exposure device 14. Note that there are cases in which the Y, M, C, K is omitted when there is no need to provide description that differentiates among Y, M, C, K.

These four image forming units 16Y, 16M, 16C, 16K are all structured similarly, and are each structured to include: an image holding body 18 that serves as an example of a body to be charged and is shaped as a solid cylinder and is driven to rotate; a charging device 20 that charges the circumferential surface of the image holding body 18; a developing device 22 that develops, by a toner of the corresponding color, an electrostatic latent image that has been formed by the image exposure of the exposure device 14 on the circumferential surface of the image holding body 18 that has been charged by the charging device 20, and makes the image visible as a toner image; and a cleaning member 24 that cleans the circumferential surface of the image holding body 18.

The image holding body 18 is structured so as to be able to hold a formed image, and more concretely, is a photoreceptor. The charging device 20 is structured to include a charging roller 23 serving as an example of a charging body that charges the circumferential surface of the image holding body 18, and a cleaning device 100 that cleans the charging roller 23.

The charging roller 23 contacts the circumferential surface of the image holding body 18 and rotates, and charges the circumferential surface of the image holding body 18. Note that the charging roller 23 is an example of a body to be cleaned that is cleaned by the cleaning device 100. The concrete structure of the cleaning device 100 is described below.

The respective image forming units 16Y, 16M, 16C, 16K are structured so as to be detachable with respect to the device main body 10A, and function as assemblies that are detachably assembled integrally with the device main body 10A. Note that it suffices for the assembly to include at least the image holding body 18, the charging roller 23 and the cleaning device 100.

Further, the image forming units 16Y, 16M, 16C, 16K may be structured so as to not be made into units and so as to, for example, be supported at a common supporting frame and not be detached from the device main body 10A.

Four semiconductor lasers, that are not illustrated and that are structured commonly for the four image forming units 16Y, 16M, 16C, 16K, are provided at the exposure device 14. Laser lights LB-Y, LB-M, LB-C, LB-K are emitted from these semiconductor lasers in accordance with gradation data.

The laser lights LB-Y, LB-M, LB-C, LB-K that exit from the semiconductor lasers are illuminated, via unillustrated f-θ lenses, onto a polygon mirror 26 that is a rotating polygon mirror, and are deflected and scanned by the polygon mirror 26. The laser lights LB-Y, LB-M, LB-C, LB-K, that have been deflected and scanned by the polygon mirror 26, are, via imaging lenses and plural mirrors that are not illustrated, scanned and exposed from obliquely downward onto exposure points on the image holding bodies 18.

The periphery of the exposure device 14 is tightly closed by a parallelepiped casing 28. Light-transmitting members 30Y, 30M, 30C, 30K, that transmit the four laser lights LB-Y, LB-M, LB-C, LB-K toward the image holding bodies 18 of the image forming units 16Y, 16M, 16C, 16K, are provided at the top portion of the casing 28.

A primary transfer unit 21 is provided above the respective image forming units 16Y, 16M, 16C, 16K. The primary transfer unit 21 is structured to include: an endless intermediate transfer belt 32; a driving roller 40 around which the intermediate transfer belt 32 is trained, and that is driven and rotated so as to circulate the intermediate transfer belt 32 in the direction of the arrow; a tension imparting roller 36 around which the intermediate transfer belt 32 is trained, and that imparts tension to the intermediate transfer belt 32; a cleaning member 38 that cleans the circumferential surface of the intermediate transfer belt 32; and primary transfer rollers 34Y, 34M, 34C, 34K that are disposed at the opposite sides of the image holding bodies 18Y, 18M, 18C, 18K with the intermediate transfer belt 32 nipped therebetween.

The toner images of the respective colors of yellow (Y), magenta (M), cyan (C), black (K), that have been successively formed on the image holding bodies 18 of the image forming units 16Y, 16M, 16C, 16K, are transferred onto the intermediate transfer belt 32 so as to be superposed one on another by the four primary transfer rollers 34Y, 34M, 34C, 34K.

A secondary transfer roller 42 is provided at the opposite side of the driving roller 40, with the intermediate transfer belt 32 nipped therebetween. The toner images of the respective colors of yellow (Y), magenta (M), cyan (C), black (K), that have been transferred onto the intermediate transfer belt 32 so as to be superposed one on another, are conveyed by the intermediate transfer belt 32, are nipped by the driving roller 40 and the secondary transfer roller 42, and are secondarily-transferred onto a recording medium P that is conveyed along a conveying path 56.

A fixing device 44 that fixes the toner image, that has been transferred on the recording medium P, onto the recording medium P by heat and pressure, is provided at the recording medium P conveying direction downstream side (hereinafter simply called downstream side) of the secondary transfer roller 42.

Ejecting rollers 46 are provided at the downstream side of the fixing device 44. The ejecting rollers 46 eject the recording medium P, on which the toner image has been fixed, out to an ejecting section 48 that is provided at the top portion of the device main body 10A of the image forming device 10.

On the other hand, an accommodating portion 50 in which the recording media P are accommodated is provided at the lower side of the interior of the device main body 10A of the image forming device 10. A feed roller 52 that sends the recording medium P, that is accommodated in the accommodating portion 50, out to the conveying path 56 is provided. A separating roller 54, that separates the recording media P one-by-one and conveys the recording medium P, is provided at the downstream side of the feed roller 52. A registration roller 58, that adjusts the conveying timing, is provided at the downstream side of the separating roller 54. Due thereto, the recording medium P, that is sent-out from the accommodating portion 50, is conveyed to the position at which the intermediate transfer belt 32 and the secondary transfer roller 42 contact one another (a secondary transfer position) by the registration roller 58 at a predetermined timing.

Conveying rollers 60 are provided next to the ejecting rollers 46. The conveying rollers 60 convey the recording medium P, on whose one side an image has been fixed by the fixing device 44, to a conveying path 62 for double-sided (duplex) printing, without the recording medium P being ejected-out onto the ejecting section 48 by the ejecting rollers 46. Due thereto, the recording medium P that is conveyed along the conveying path 62 for double-sided printing is, in a state in which the obverse and reverse thereof are inverted, again conveyed to the registration roller 58. This time, a toner image is transferred and fixed onto the reverse of the recording medium P, and the recording medium P is ejected onto the ejecting section 48.

Due to this structure, an image is formed on the recording medium P as follows.

First, gradation data of the respective colors is successively outputted from the image processing section 12 to the exposure device 14. The laser lights LB-Y, LB-M, LB-C, LB-K, that are emitted from the exposure device 14 in accordance with the gradation data, are scanned and exposed onto the circumferential surface of the image holding bodies 18 that have been charged by the charging devices 20 (the charging rollers 23), such that electrostatic latent images are formed on the circumferential surfaces of the image holding bodies 18. The electrostatic latent images formed on the image holding bodies 18 are made visible as toner images of the respective colors of yellow (Y), magenta (M), cyan (C), black (K) respectively by the developing devices 22Y, 22M, 22C, 22K.

The toner images of the respective colors of yellow (Y), magenta (M), cyan (C), black (K) that are formed on the image holding bodies 18 are transferred in a superposed manner onto the intermediate transfer belt 32 that circulates, by the primary transfer rollers 34 of the primary transfer unit 21 that is disposed over the region above the image forming units 16Y, 16M, 16C, 16K.

The toner images of the respective colors, that have been transferred in a superposed manner onto the intermediate transfer belt 32 that circulates, are secondarily-transferred, by the secondary transfer roller 42, onto the recording medium P that is conveyed from the accommodating section 50 via the conveying path 56 by the feed roller 52, the separating roller 54 and the registration roller 58.

The recording medium P, on which the toner images have been transferred, is conveyed to the fixing device 44. The toner images transferred on the recording medium P are fixed to the recording medium P by the fixing device 44. After fixing, the recording medium P is ejected by the ejecting rollers 46 to the ejecting section 48 that is provided at the top portion of the device main body 10A of the image forming device 10.

If images are to be formed on both sides of the recording medium P, the conveying direction of the recording medium P, on whose one surface an image has been fixed by the fixing device 44, is switched without the recording medium P being ejected to the ejecting section 48 by the ejecting rollers 46, and the recording medium P is conveyed via the conveying rollers 60 to the conveying path 62 for double-sided printing. Due to the recording medium P being conveyed along the conveying path 62 for double-sided printing, the obverse and the reverse of the recording medium P are inverted, and the recording medium P is again conveyed to the registration roller 58. This time, toner images are transferred and fixed onto the reverse of the recording medium P. After the transferring and fixing, the recording medium P is ejected by the ejecting rollers 46 onto the ejecting section 48.

Structure of Cleaning Device Relating to Present Exemplary Embodiment

Figure 2:
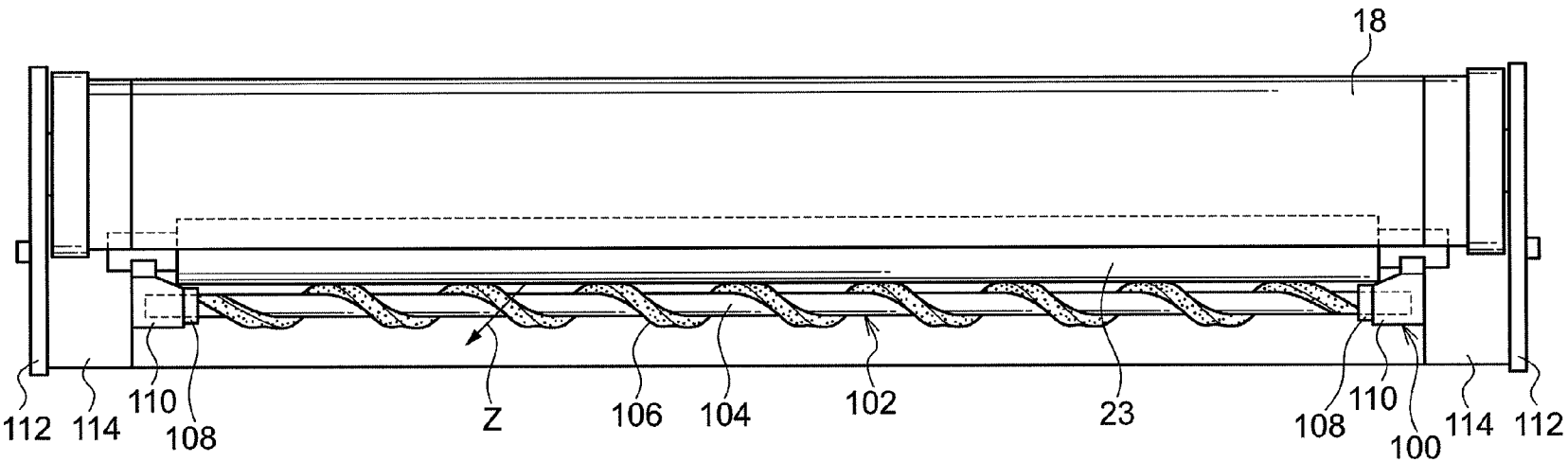
FIG. 2 is a schematic drawing showing the structure of a cleaning device relating to the present exemplary embodiment.

The structure of the cleaning device relating to the present exemplary embodiment is described next. FIG. 2 is a schematic drawing showing the structure of the cleaning device relating to the present exemplary embodiment.

As shown in FIG. 2, the cleaning device 100 relating to the present exemplary embodiment has a cleaning body 102 that cleans the charging roller 23 that serves as an example of a body to be cleaned. The cleaning body 102 has a shaft 104 that is disposed along the axial direction of the charging roller 23, and a cleaning member 106 that is spirally wound around the outer periphery of the shaft 104.

The shaft 104 is formed in the shape of a solid cylinder and of a metal material, and has a length along the axial direction of the charging roller 23.

Figure 5A:
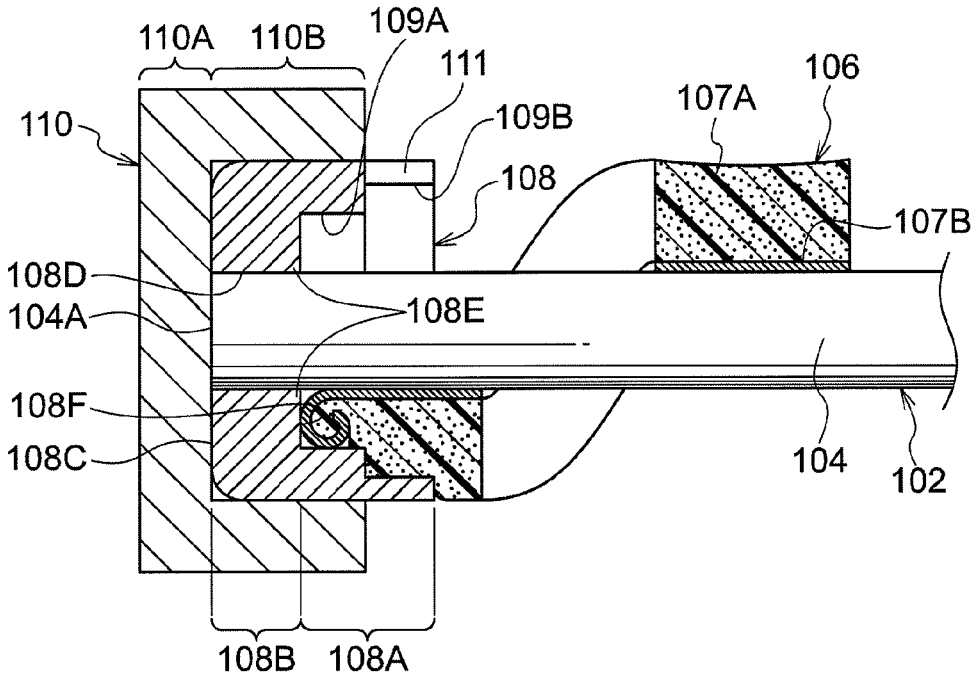
FIGS. 5A and 5B are cross-sectional views showing the structure of a pressing member relating to the present exemplary embodiment.
Figure 5B:
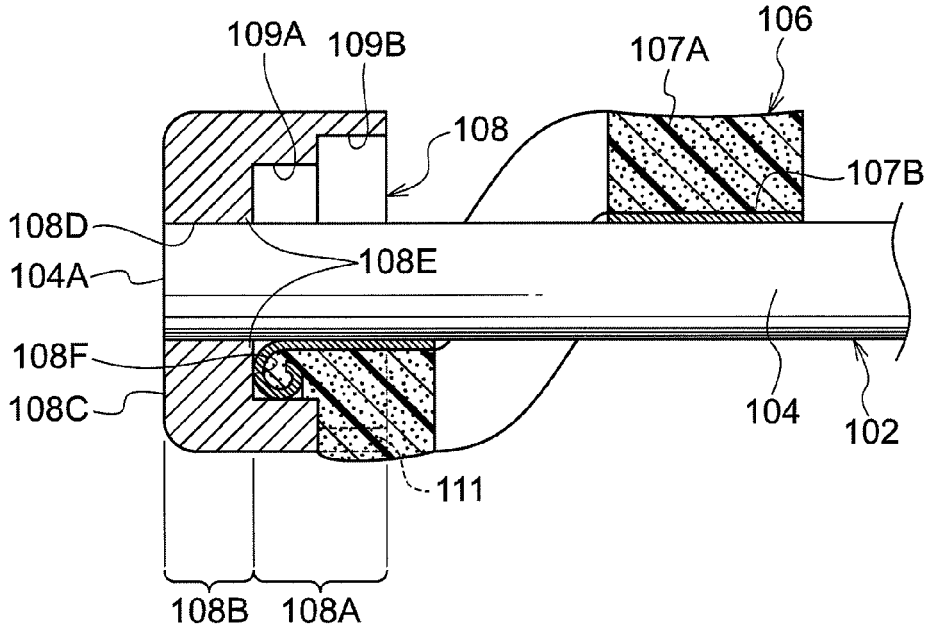

The cleaning member 106 is formed in the shape of a strip, and, as shown in FIGS. 5A and 5B, has an elastic layer 107A that is elastically deformable, and an adhesive layer 107B whose obverse is adhered to the elastic layer 107A and whose reverse is adhered to the shaft 104. Note that the adhesive layer 107B may be a single-layer adhesive layer or a multi-layer adhesive layer. When the adhesive layer 107B is structured as a multi-layer adhesive layer, non-adhesive layers such as an electrically-conductive layer, a non-electrically-conductive layer, a semiconductor layer, a heat insulating layer, a heat transmitting layer or the like may be interposed between the respective adhesive layers.

The elastic layer 107A is structured by, for example, a sponge formed of urethane resin or the like. The adhesive layer 107B is structured by an adhesive material such as, for example, an adhesive, double-sided tape, or the like. The cleaning member 106 is fixed by the adhesive layer 107B to the outer periphery of the shaft 104 from one axial direction end portion thereof to the other end portion.

Figure 3:
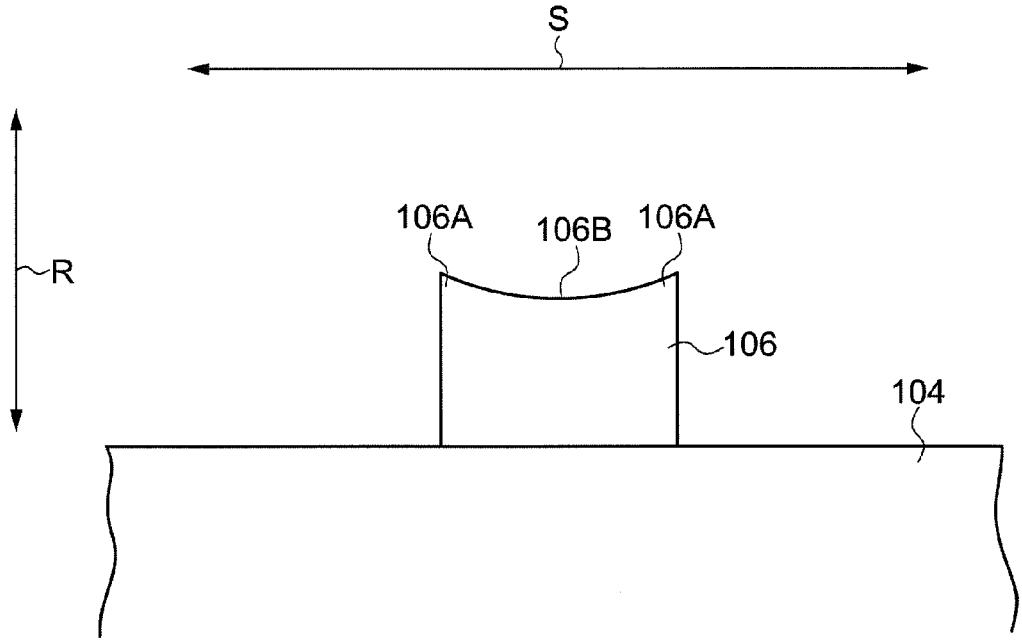
FIG. 3 is a drawing showing the cross-section, along the axial direction of a shaft, of a foam material relating to the present exemplary embodiment.

As shown in FIG. 3, in a cross-section along an axial direction S of the shaft 104, the cleaning member 106 is shaped as a quadrilateral that is enclosed by four sides (including a curve). At both end portions in the axial direction S of the shaft 104, the cleaning member 106 has projecting portions 106A that project toward the outer side in a radial direction R. The projecting portions 106A are formed by creating a difference in outer diameters between a central portion 106B at the circumferential surface (the top surface in FIG. 3) of the cleaning member 106 and the both end portions 106A by, for example, imparting tension to the cleaning member 106. Note that, also in the cross-section along the direction (Z direction in FIG. 2) orthogonal to the direction of winding thereof, the cleaning member 106 is similarly shaped as a quadrilateral that is enclosed by four sides (including a curve), and has, at the both end portions in the transverse direction, the projecting portions 106A that project toward the outer side in the radial direction R.

At the cleaning body 102, the circumferential surface (the top surface in FIG. 3), that includes the projecting portions 106A of the cleaning member 106, contacts the charging roller 23 and the shaft 104 is slave-rotated. Due thereto, the circumferential surface of the cleaning member 106 wipes the circumferential surface of the charging roller 23 and the projecting portions 106A of the cleaning member 106 scrape foreign matter off, and the foreign matter is thereby removed.

Figure 4:
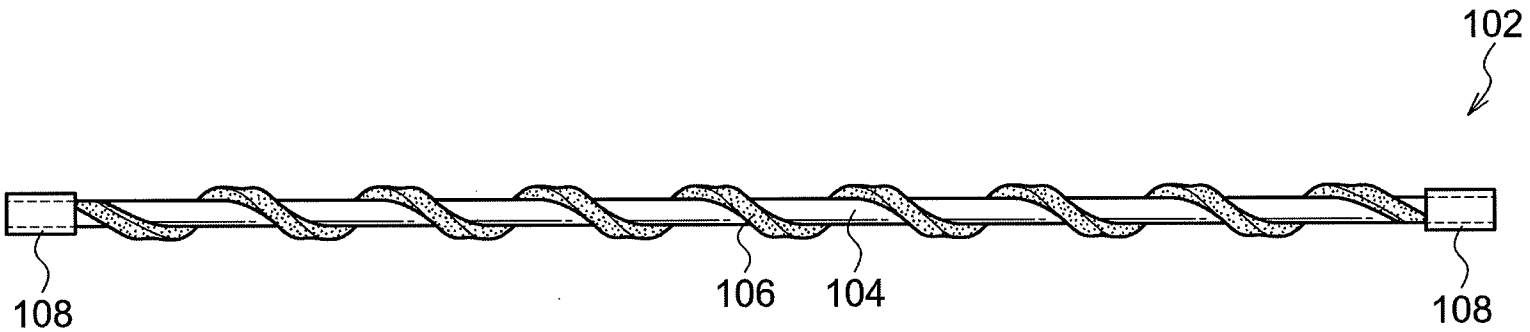
FIG. 4 is a schematic drawing showing the structure of a cleaning body relating to the present exemplary embodiment.

As shown in FIG. 4, pressing members 108, that are cylindrical-tube-shaped and that press the respective longitudinal direction end portions of the cleaning member 106 between the pressing members 108 and the shaft 104 and that serve as examples of contacting members that contact the adhesive layer 107B at positions away from the shaft 104, are provided at the both axial direction end portions of the shaft 104.

As shown in FIG. 5A, the pressing member 108 has a cylindrical tube portion 108A that is shaped as a cylindrical tube and whose axial direction one end (the right end in FIG. 5A) is open, and a holding portion 108B that is provided integrally with the cylindrical tube portion 108A at the other axial direction end (the left end in FIG. 5A) of the cylindrical tube portion 108A and is held at the shaft 104.

An insertion hole 108D into which the shaft 104 is inserted is formed in the holding portion 108B. The shaft 104 is formed to have a cross-sectional configuration that is such that rotation is prevented, for example, is D-cut or the like. Due to the shaft 104 being inserted in the insertion hole 108D, the holding portion 108B is held at the shaft 104, and the pressing member 108 rotates integrally with the shaft 104. Further, the holding portion 108B is held at the shaft 104 with an end surface 108C at a position that is in the same plane as an end surface 104A of the shaft 104. Note that the end surface 104A of the shaft 104 may be positioned further toward the inner side (the right side in FIG. 5A) than the end surface 108C of the holding portion 108B.

The cylindrical tube portion 108A is formed along the circumferential direction of the shaft 104, and has a first inner portion 109A and a second inner portion 109B that is disposed further toward the axial direction central side of the shaft 104 than the first inner portion 109A and whose inner diameter is larger than that of the first inner portion 109A. By making the inner diameters of the first inner portion 109A and the second inner portion 109B different in this way, a step is formed between the first inner portion 109A and the second inner portion 109B.

The first inner portion 109A is structured so as to nip, between the first inner portion 109A and the circumferential surface of the shaft 104, the portion of the adhesive layer 107B that is wound-in the elastic layer 107A, and so as to compress and press the elastic layer 107A and the adhesive layer 107B between the first inner portion 109A and the circumferential surface of the shaft 104. The second inner portion 109B is structured so as to nip the elastic layer 107A between the second inner portion 109B and the circumferential surface of the shaft 104, and so as to compress and press the elastic layer 107A between the second inner portion 109B and the circumferential surface of the shaft 104. In this way, the first inner portion 109A and the second inner portion 109B function as pressing portions that press the elastic layer 107A between themselves and the shaft 104. Note that, for convenience, the above describes a case in which the first inner portion 109A nips, between itself and the circumferential surface of the shaft 104, the portion of the adhesive layer 107B that is wound-in the elastic layer 107A. However, the portion of the adhesive layer 107B that is nipped between the first inner portion 109A and the circumferential surface of the shaft 104 is not limited to the portion of the adhesive layer 107B that is wound-in the elastic layer 107A, and, depending on the case, a portion of the adhesive layer 107B that is rolled-up together with the elastic layer 107A, a portion of the adhesive layer 107B that is merely rolled-up, a portion of the adhesive layer 107B that is pushed and peeled-off so as to swell, a portion of the adhesive layer 107B that is pushed and peeled-off so as to adhere irregularly or in a bellows-like shape, or the like, may be nipped between the first inner portion 109A and the circumferential surface of the shaft 104. Moreover, the adhesive layer 107B may be nipped as far as between the second inner portion 109B and the circumferential surface of the shaft 104.

Figure 6:
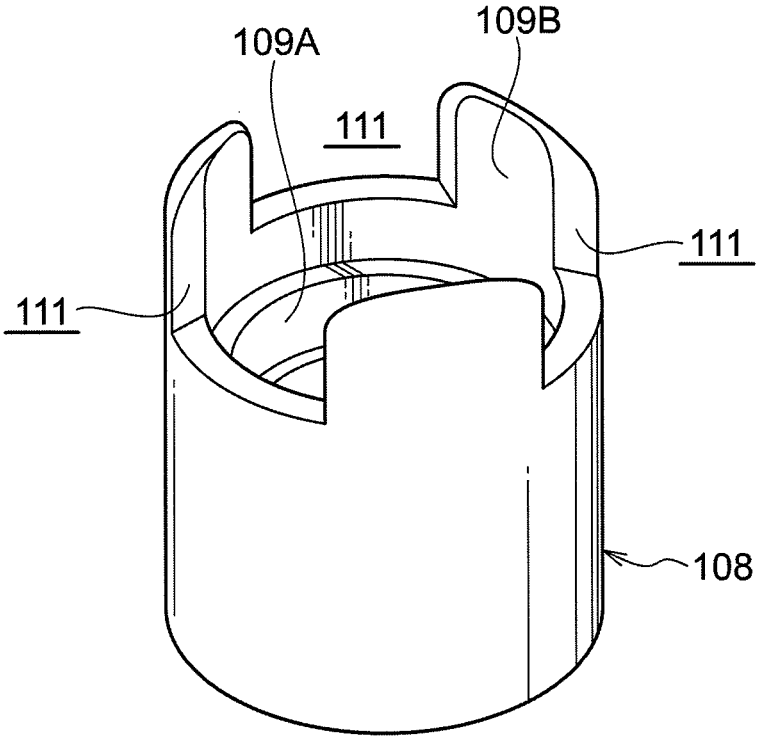
FIG. 6 is a perspective view showing the structure of the pressing member relating to the present exemplary embodiment.

As shown in FIG. 5B and FIG. 6, plural cut-out portions 111, that expose the elastic layer 107A to the circumferential side of the pressing member 108, are formed in the second inner portion 109B. In the present exemplary embodiment, three of the cut-out portions 111 are formed along the circumferential direction of the second inner portion 109B.

As shown in FIG. 2, a pair of supporting members 110, that rotatably support the pressing members 108 respectively, are provided at the cleaning device 100. Concretely, as shown in FIG. 5A, each of the supporting members 110 is structured to have a cylinder portion 110B that is shaped as a cylindrical tube, and whose central side in the axial direction of the shaft 104 is open, and whose opposite side is closed by a side wall 110A. The respective pressing members 108 can, while sliding along the inner walls of the cylinder portions 110B, rotate integrally with the shaft 104 in the circumferential direction of the inner walls.

As shown in FIG. 2, the pair of supporting members 110 are fixed respectively to fixing portions 114 that are formed at side plates 112 at the both sides. Note that, in the present exemplary embodiment, the axial direction end portions of the charging roller 23 are rotatably supported by the supporting members 110, and the axial direction end portions of the image holding body 18 are supported so as to be rotatable with respect to the side plates 112.

In the present exemplary embodiment, as shown in FIG. 5A, the longitudinal direction end portion of the adhesive layer 107B of the cleaning member 106 is separated from the shaft 104 toward the outer side in the radial direction of the shaft 104, and is curled while biting-into the intermediate portion in the thickness direction (the vertical direction in FIG. 5A) of the elastic layer 107A. Due thereto, the adhesive layer 107B is wound-into a portion of the elastic layer 107A, and the reverse of the adhesive layer 107B, that is adhered to the shaft 104, is curled-up from the shaft 104.

The reverse of the adhesive layer 107B, that is adhered to the shaft 104, contacts the first inner portion 109A and an inner wall 108F of the holding portion 108B of the pressing member 108.

Figure 7A:
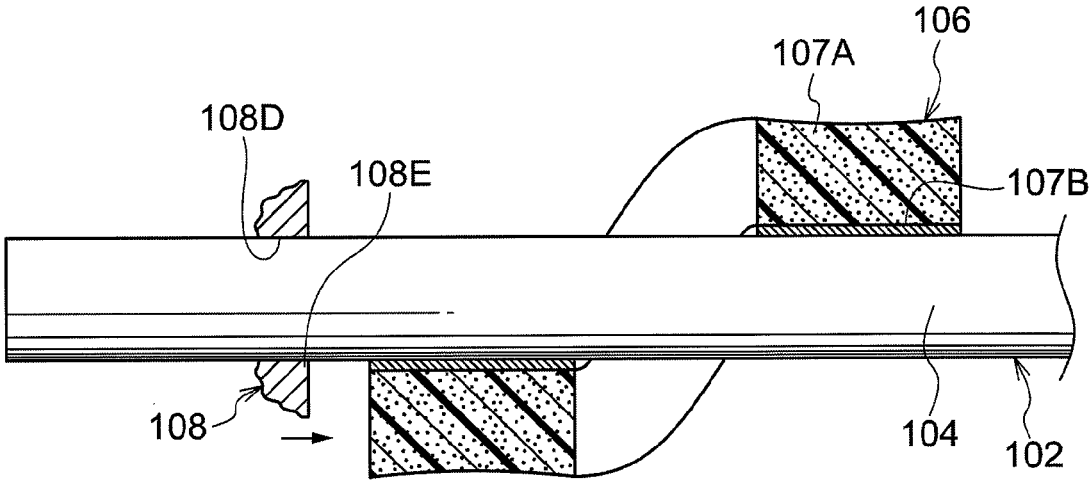
FIGS. 7A and 7B are schematic drawings showing changes in the state of a cleaning member when the pressing member relating to the present exemplary embodiment is mounted to the shaft.
Figure 7B:
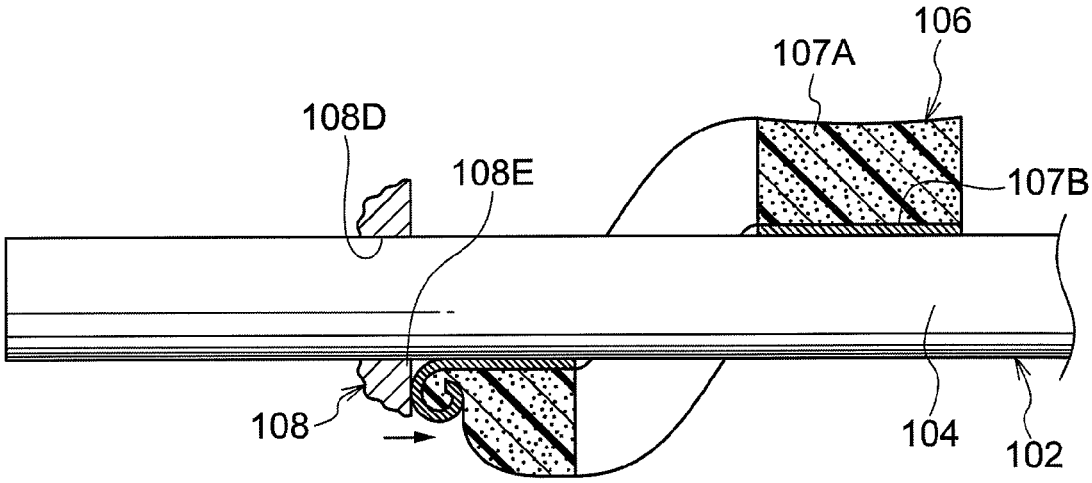

The structure that causes the adhesive layer 107B to contact the pressing member 108 in this way is formed by the following processes for example. Namely, as shown in FIG. 7A, the cleaning member 106 is once adhered to the shaft 104 by the adhesive layer 107B. Next, the shaft 104 is inserted into the insertion hole 108D of the holding portion 108B, and the pressing member 108 is mounted to the shaft 104. Due thereto, as shown in FIG. 7B, the adhesive layer 107B is pushed and peeled-off by an edge portion 108E of the insertion hole 108D of the holding portion 108B. Note that only a portion of the pressing member 108 is shown in FIGS. 7A and 7B, in order to make it easier to understand the state of the cleaning member 106.

Figure 8:
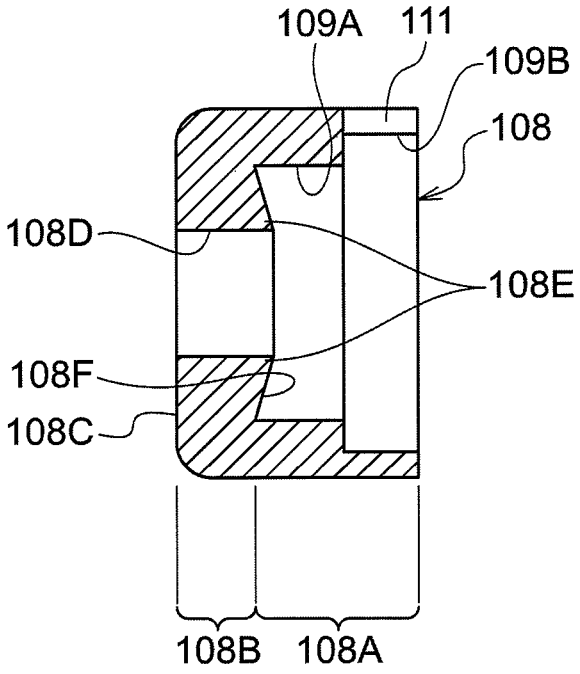
FIG. 8 is a schematic drawing showing a modified example in which the inner wall of a holding portion is formed in a tapered shape.

Note that, in order to make it easy to push and peel the adhesive layer 107B off, the adhesive layer 107B may be pushed and peeled-off after the end portion of the adhesive layer 107B is made to rise-up from the shaft 104. Or, as shown in FIG. 8, the inner wall 108F portion of the holding portion 108B may be formed in a taper shape such that the edge portion 108E of the holding portion 108B projects-out at an acute angle.

Operation of Present Exemplary Embodiment

The operation of the present exemplary embodiment is described next.

In the present exemplary embodiment, foreign matter, such as developer that remains on the image holding body 18 without being transferred onto the intermediate transfer belt 32, and the like, is removed from the image holding body 18 by the cleaning member 24.

Foreign matter, such as external additives and the like whose particle diameters are relatively small among the components of the developer, slips-past the cleaning member 24. The foreign matter such as external additives and the like that slips-past the cleaning member 24 adheres to the surface of the charging roller 23.

The foreign matter that has adhered to the surface of the charging roller 23 is removed by the circumferential surface (the top surface in FIG. 3) of the cleaning member 106, that includes the projecting portions 106A, contacting the charging roller 23, and this circumferential surface of the cleaning member 106 wiping the circumferential surface of the charging roller 23 and the projecting portions 106A of the cleaning member 106 scraping the foreign matter off.

Figure 10A:
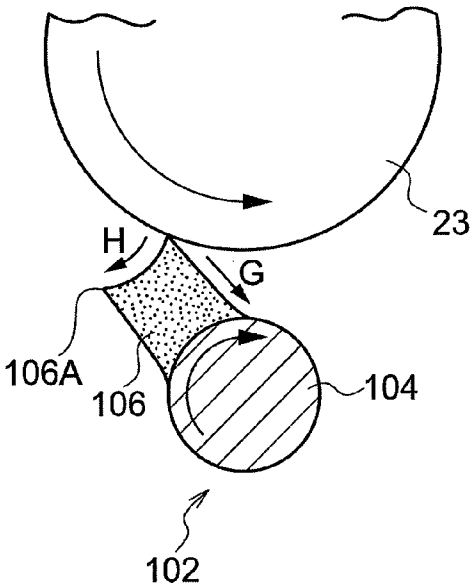
FIGS. 10A, 10B and 10C are explanatory drawings for explaining the cleaning operation of the cleaning body relating to the present exemplary embodiment.
Figure 10B:
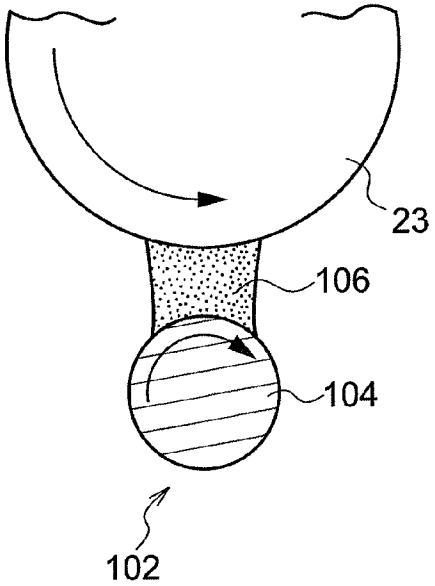
Figure 10C:
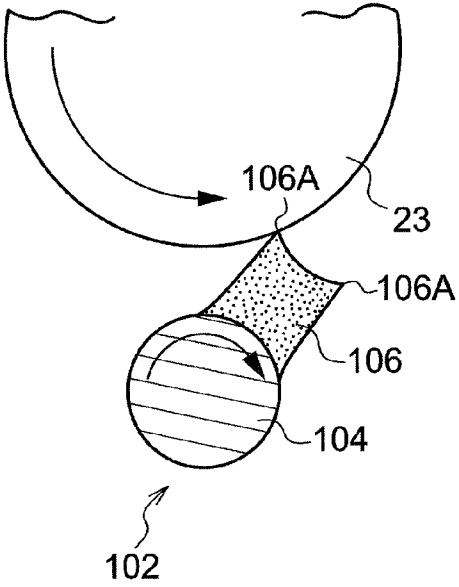

Specifically, as shown in FIGS. 10A and 10B, the foreign matter, such as external additives and the like that has adhered to the circumferential surface of the charging roller 23 that rotates in the direction of the arrow, is pushed and cohered (agglutinated) by the cleaning member 106 due to the projecting portions 106A at the cleaning member 106 of the cleaning body 102 that is slave-rotated being pushed by the circumferential surface of the charging roller 23 and elastically deforming (elastically compressing) in the heightwise direction (direction G shown in FIG. 10A) and the widthwise direction (direction H shown in FIG. 10A) of the cleaning member 106. Then, as shown in FIG. 10C, the projecting portions 106A at the cleaning member 106 of the cleaning body 102 that is slave-rotated is restored, and due to this restoring force, the cohered foreign matter such as external additives and the like is loosened from the dense state and is repelled from the circumferential surface of the charging roller 23.

Here, in the present exemplary embodiment, as shown in FIG. 5A, the adhesive layer 107B of the cleaning member 106 contacts the first inner portion 109A and the inner wall 108F of the holding portion 108B of the pressing member 108. Namely, the adhesive layer 107B, that was adhered to the circumferential surface of the shaft 104, is, at a position away from the shaft 104, adhered to a surface of a member that is different than the shaft 104, and the surface thereof faces a direction that is different than the circumferential surface of the shaft 104. Due thereto, as compared with a case in which the adhesive layer 107B is adhered only to the shaft 104, even if a force that attempts to peel the adhesive layer 107B off is applied to the adhesive layer 107B, the adhesive layer 107B can resist this force, and it is difficult for the longitudinal direction end portion of the cleaning member 106 to be peeled-off from the shaft 104.

By the first inner portion 109A, the pressing member 108 nips, between the pressing member 108 and the shaft 104, the portion of the adhesive layer 107B that is wound-in the elastic layer 107A, and compresses and presses the adhesive layer 107B and the elastic layer 107A between the pressing member 108 and the shaft 104. By the second inner portion 109B, the pressing member 108 nips the elastic layer 107A between the pressing member 108 and the shaft 104, and compresses and presses the elastic layer 107A between the pressing member 108 and the shaft 104. For this reason as well, it is difficult for the longitudinal direction end portion of the cleaning member 106 to be peeled-off from the shaft 104.

Further, because the inner diameter of the second inner portion 109B is larger than that of the first inner portion 109A, the pressure that deforms the elastic layer 107A lessens along the direction toward the axial direction central side of the shaft 104. Therefore, in a vicinity of the pressing member 108, it is difficult for dispersion to arise in the outer diameter of the elastic layer 107A, and the region that is made to contact the charging roller 23 well is ensured to be wide.

Because the elastic layer 107A is exposed from the cut-out portions 111 that are formed in the second inner portion 109B, the cleaning surface area that cleans the charging roller 23 is increased.

Figure 9:
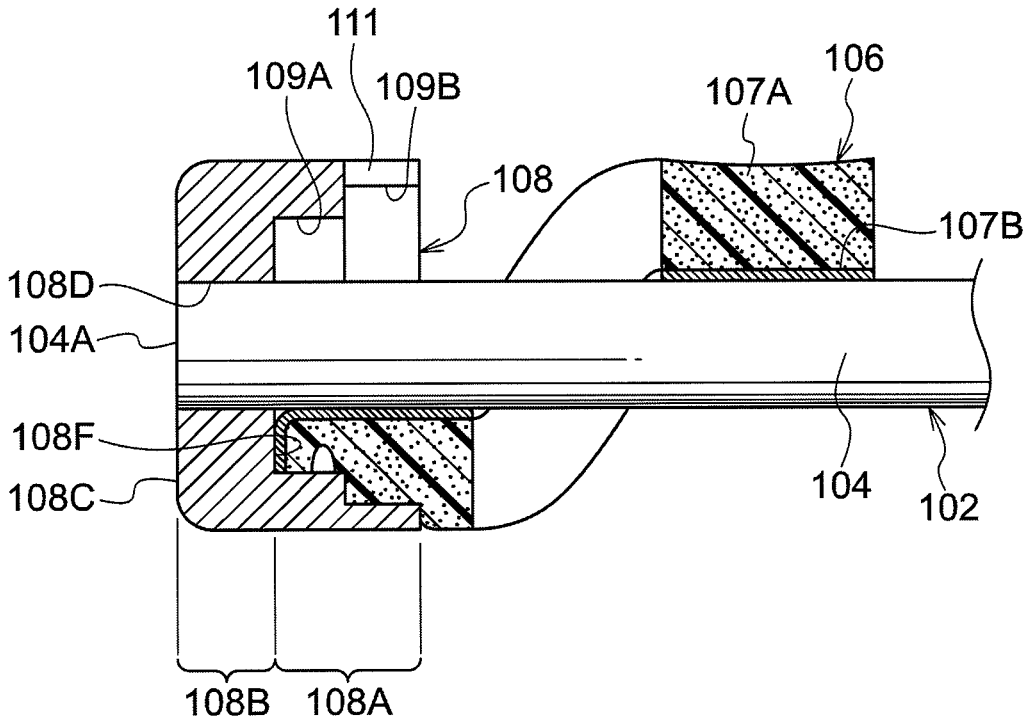
FIG. 9 is a schematic drawing showing a modified example in which an adhesive layer contacts only the holding portion.

Note that, in the above-described exemplary embodiment, the adhesive layer 107B contacts the first inner portion 109A and the inner wall 108F of the holding portion 108B. However, as shown in FIG. 9, the amount of bending of the adhesive layer 107B may be made to be smaller than in the case shown in FIG. 5A, such that the adhesive layer 107B contacts only the inner wall 108F of the holding portion 108B.

Figure 11A:
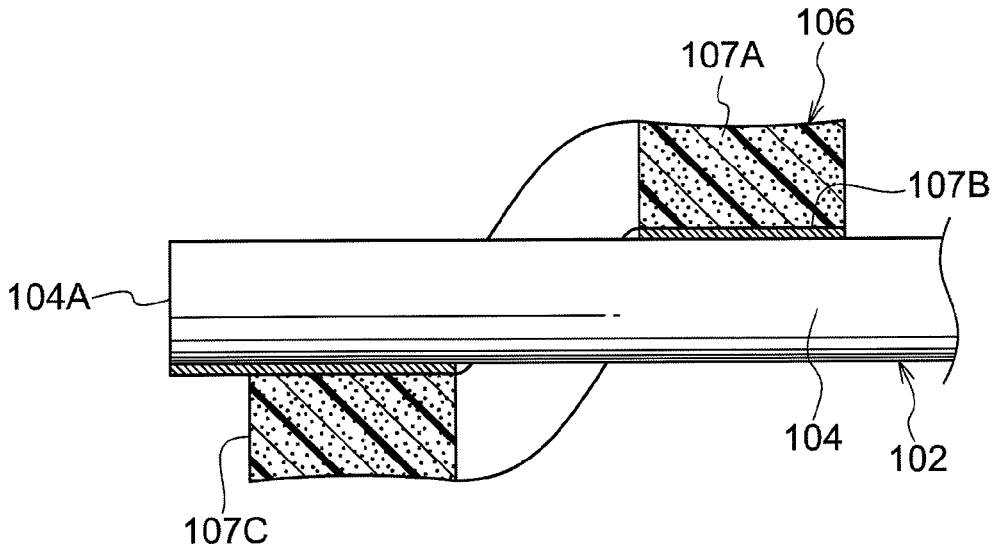
FIGS. 11A and 11B are schematic drawings showing a modified example that is structured such that the adhesive layer juts-out from the end portion of an elastic layer.
Figure 11B:
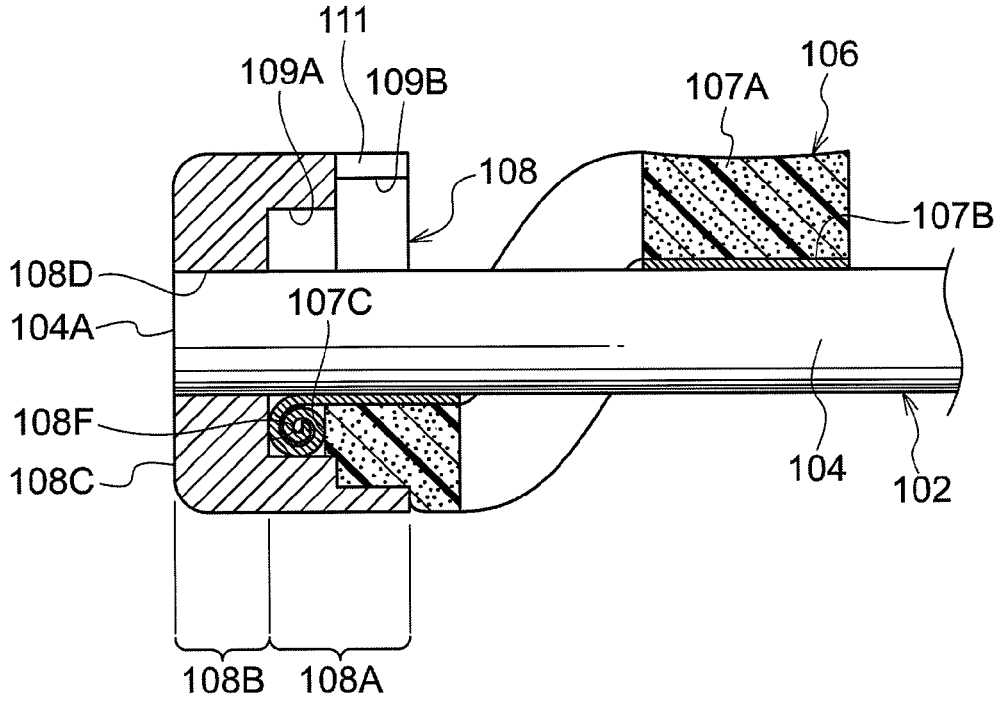

Further, the adhesive layer 107B may be structured so as to jut-out from the end portion of the elastic layer 107A toward the axial direction end portion of the shaft 104 as shown in FIG. 11A, and the pressing member 108 may be mounted while pushing and peeling-off the adhesive layer 107B as shown in FIG. 11B. In accordance with this structure, the adhesive layer 107B adheres to the end surface of the elastic layer 107A, and further, portions of the elastic layer 107B are adhered to one another. Due thereto, as compared with a structure in which the adhesive layer 107B does not jut-out from the elastic layer 107A, the surface area of contact of the adhesive layer 107B with respect to the elastic layer 107A and the pressing member 108 increases. Further, in this structure, the adhesive layer 107B contacts an end surface 107C of the elastic layer 107A and the pressing member 108 between the end surface 107C of the elastic layer 107A and the pressing member 108, without being wound-in the elastic layer 107A.

Figure 12A:
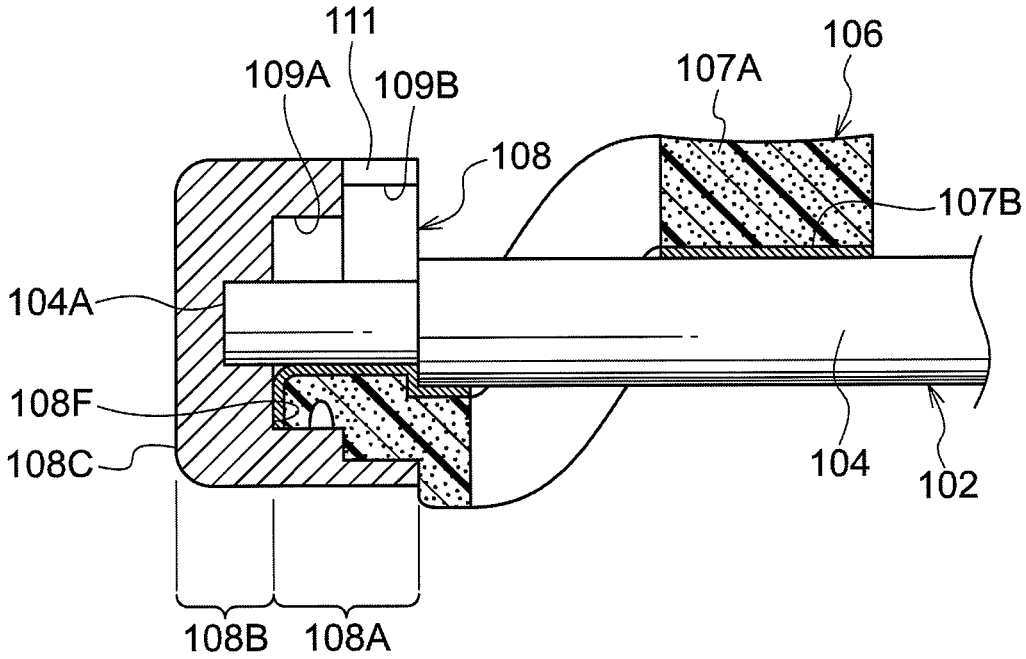
FIGS. 12A and 12B are schematic drawings showing modified examples in which the holding portion covers the end surface of the shaft.
Figure 12B:
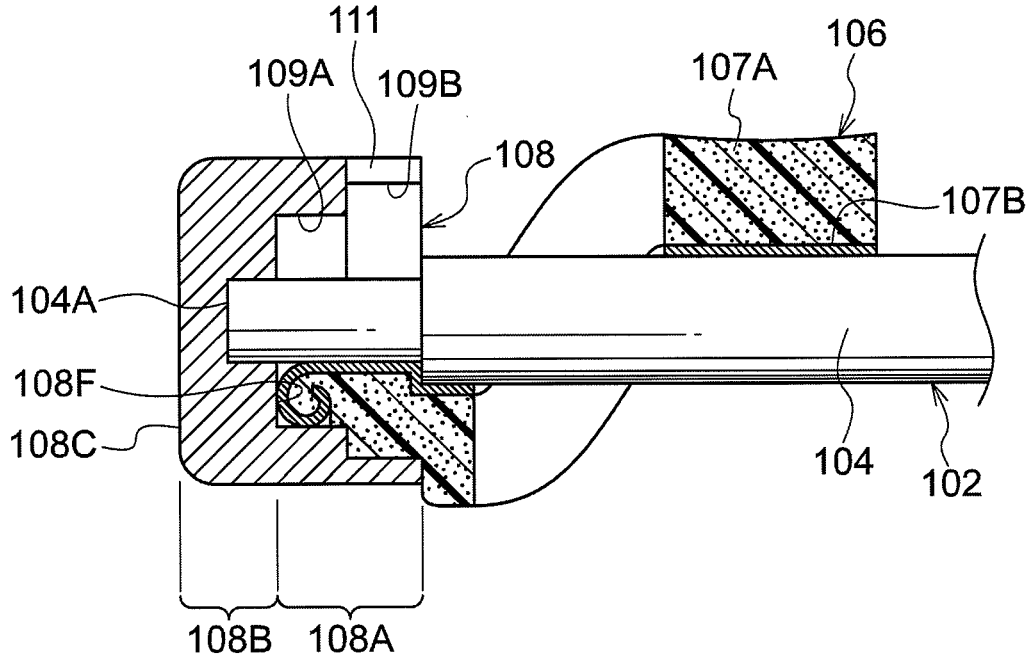

Moreover, as shown in FIGS. 12A and 12B, the holding portion 108B may be structured so as to cover the end surface 104A of the shaft 104, without forming the insertion hole 108D in the holding portion 108B. In this structure also, as shown in FIG. 12A, the adhesive layer 107B may be structured so as to contact only the inner wall 108F of the holding portion 108B. Or, as shown in FIG. 12B, the adhesive layer 107B may be structured so as to contact the first inner portion 109A and the inner wall 108F of the holding portion 108B. Note that, in the structures shown in FIG. 12A and FIG. 12B, the shaft diameter of the axial direction end portion of the shaft 104 is made to be smaller than at the axial direction central portion side thereof.

Figure 13A:
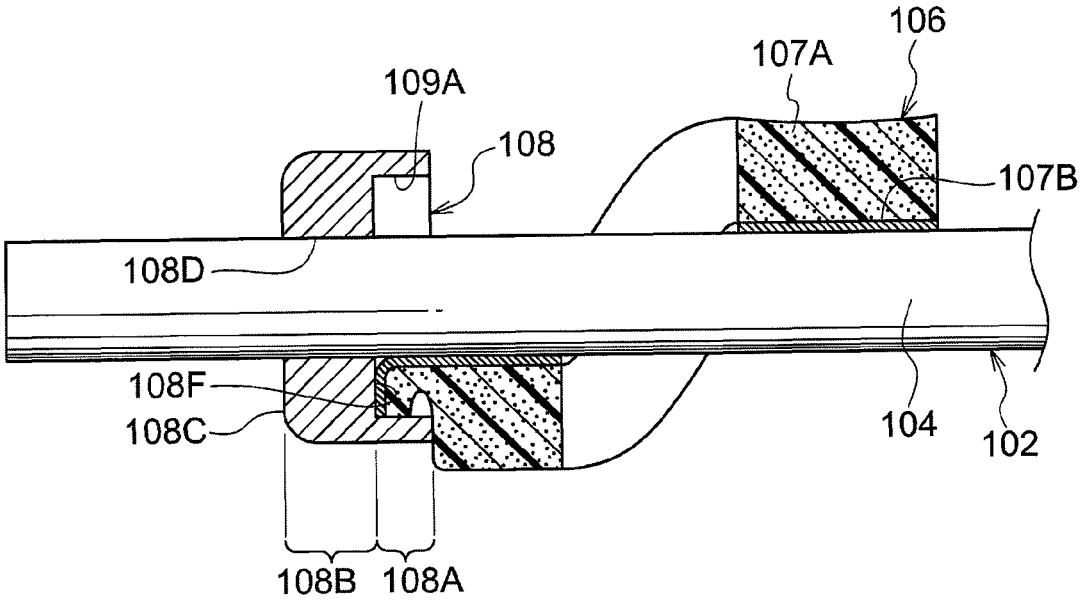
FIGS. 13A and 13B are schematic drawings showing modified examples in which the pressing member is structured only by a first inner portion.
Figure 13B:
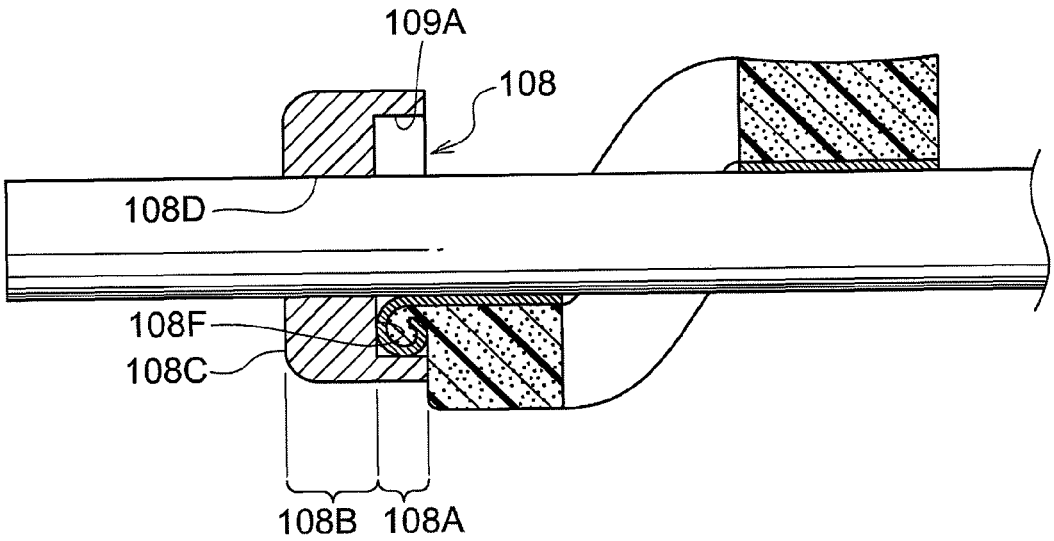

Still further, as shown in FIGS. 13A and 13B, the pressing member 108 may be structured only by the first inner portion 109A, without having the second inner portion 109B. In this structure also, as shown in FIG. 13A, the adhesive layer 107B may be structured so as to contact only the inner wall 108F of the holding portion 108B. Or, as shown in FIG. 13B, the adhesive layer 107B may be structured so as to contact the first inner portion 109A and the inner wall 108F of the holding portion 108B.

Figure 14A:
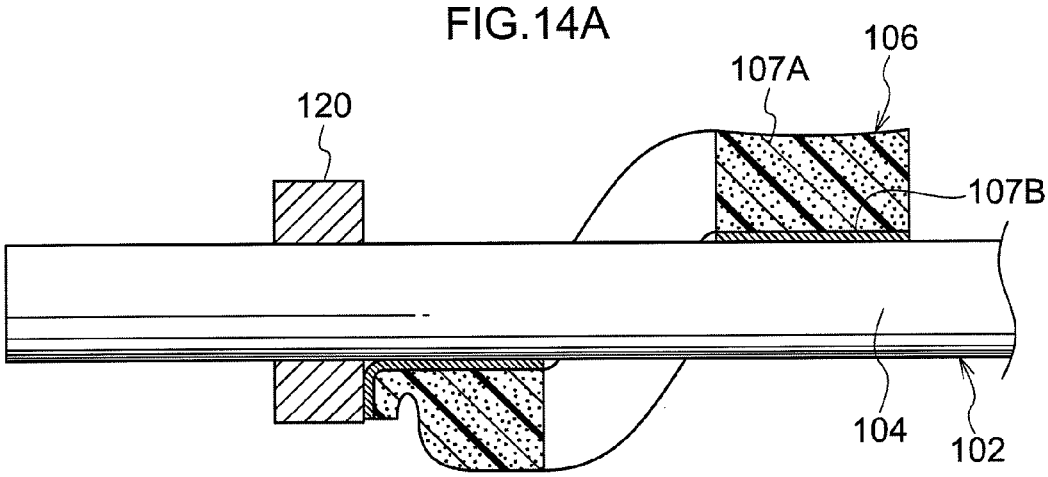
FIGS. 14A, 14B and 14C are schematic drawings showing modified examples structured by a contacting member instead of the pressing member.
Figure 14B:
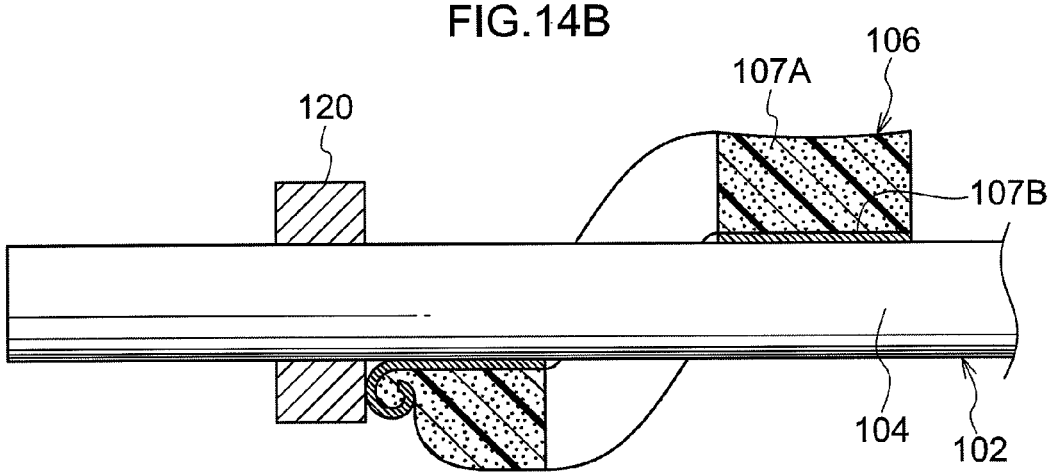
Figure 14C:
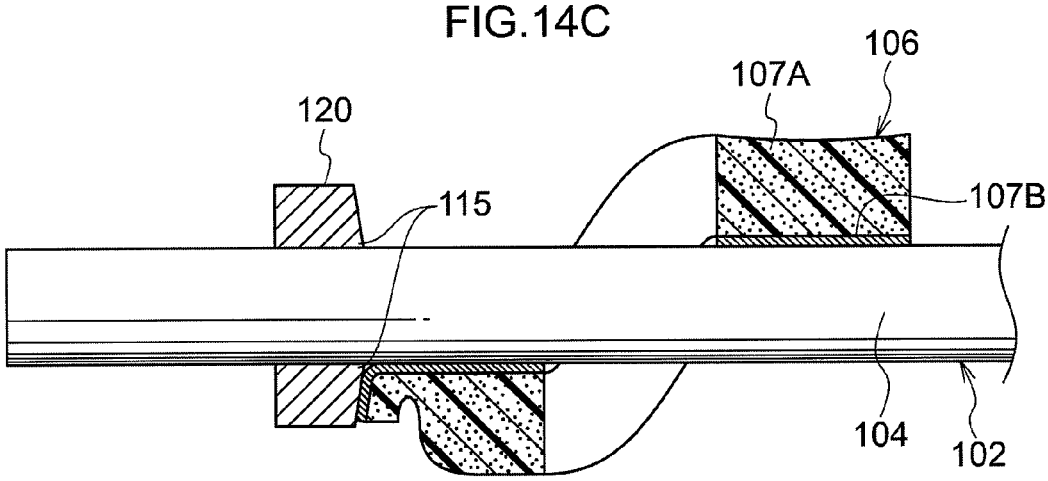

The contacting member that contacts the adhesive layer at a position away from the shaft 104 may be, as shown in FIGS. 14A, 14B and 14C, a contacting member 120 that is structured only by the holding portion 108B without having the first inner portion 109A and the second inner portion 109B at the pressing member 108. As shown in FIG. 14C, tapered portions 115 for making it easy to push and peel-off the adhesive layer 107B, may be formed at the contacting member 120.

Figure 15:
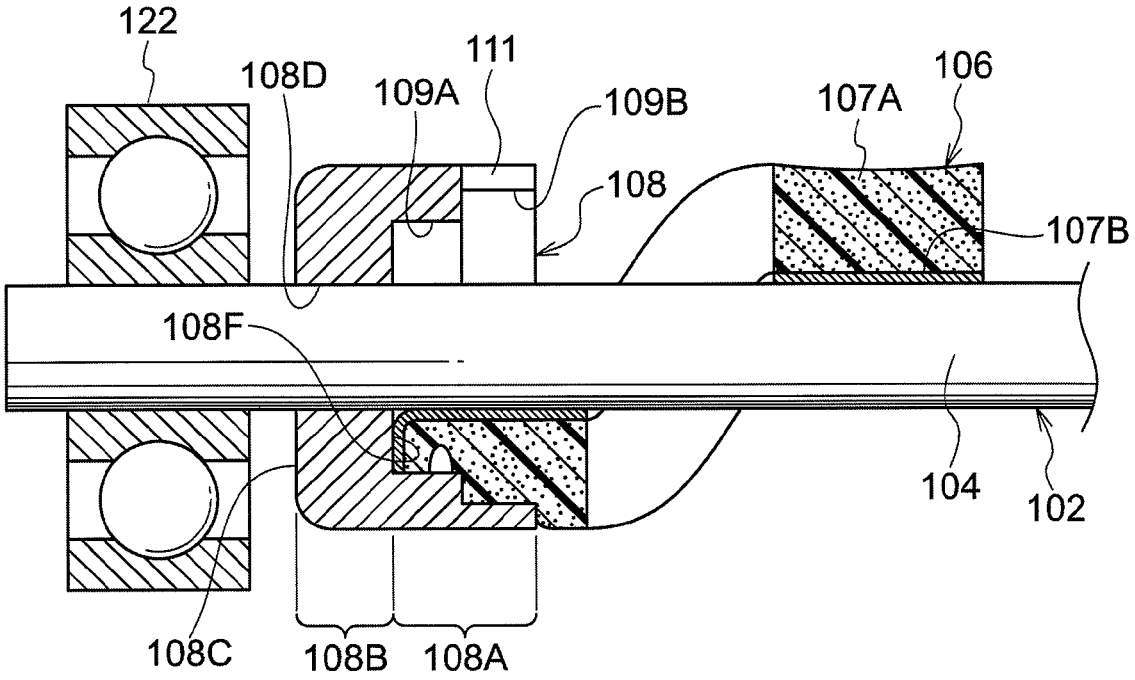
FIG. 15 is a schematic drawing showing a modified example in which the shaft is supported rotatably by a bearing.

Moreover, as shown in FIG. 15, the shaft 104 may project-out from the end surface 108C of the holding portion 108B, and may be rotatably supported by a bearing 122 and not the pressing member 108. Note that the structures shown from FIG. 13A through FIG. 14C also may be structured such that the shaft 104 is rotatably supported by the bearing 122 as shown in FIG. 15. Further, the bearing 122 may be a rolling bearing as illustrated, or may be a slide bearing.

The present invention is not limited to the above-described exemplary embodiments, and various modifications, changes, and improvements may be made thereto.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning body comprising:

a shaft;

a cleaning member that is spirally wound around the shaft, and that has an elastic layer and an adhesive layer whose obverse is adhered to the elastic layer and whose reverse is adhered to the shaft; and a contacting member that is provided on at least one end portion in an axial direction of the shaft, and the adhesive layer is bent in a radial direction of the shaft along the contacting member and adheres to the contacting member, wherein the adhesive layer is bent in the radial direction of the shaft along the contacting member and a radial side of the elastic layer.

2. The cleaning body of claim 1, wherein the contacting member has a pressing portion that is located along a circumferential direction of the shaft and that presses the elastic layer between the pressing portion and the shaft.

3. A cleaning body comprising:

a shaft;

a cleaning member that is spirally wound around the shaft, and that has an elastic layer and an adhesive layer whose obverse is adhered to the elastic layer and whose reverse is adhered to the shaft; and a contacting member that is provided on at least one end portion in an axial direction of the shaft, and that contacts the adhesive layer at a position away from an circumferential surface of the shaft, wherein the contacting member has a pressing portion that is located along a circumferential direction of the shaft and that presses the elastic layer between the pressing portion and the shaft, and the pressing portion has a first inner portion that presses the elastic layer between the first inner portion and the shaft, and a second inner portion that is disposed further toward an axial direction central side of the shaft than the first inner portion, and whose inner diameter is larger than an inner diameter of the first inner portion, and that presses the elastic layer between the second inner portion and the shaft.

4. A cleaning body comprising:

a shaft;

a cleaning member that is spirally wound around the shaft, and that has an elastic layer and an adhesive layer whose obverse is adhered to the elastic layer and whose reverse is adhered to the shaft; and a contacting member that is provided on at least one end portion in an axial direction of the shaft, and that contacts the adhesive layer at a position away from an circumferential surface of the shaft, wherein the contacting member has a pressing portion that is located along a circumferential direction of the shaft and that presses the elastic layer between the pressing portion and the shaft, and the pressing portion has a cut-out portion that exposes the elastic layer.

5. A cleaning device comprising:

a supporting member that rotatably supports the contacting member of the cleaning body of claim 1; and the cleaning body that cleans a body to be cleaned, while the cleaning member contacts the body to be cleaned that rotates and the contacting member and the shaft are slave-driven integrally.

6. A charging device comprising:

the cleaning device of claim 5; and a charging body that serves as the body to be cleaned.

7. An assembly comprising:

the cleaning device of claim 5;

a body to be charged; and a charging body that charges the body to be charged and that serves as the body to be cleaned, wherein the cleaning device, the body to be charged, and the charging body are integrally assembled and detachably mounted at a device main body.

8. An image forming device comprising:

the cleaning device of claim 5;

an image holding body that can hold an image;

a charging body that charges the image holding body, and that serves as the body to be cleaned;

an exposure device that exposes an image to the image holding body that has been charged by the charging body, and forms an electrostatic latent image; and a developing device that develops the electrostatic latent image formed on the image holding body by the exposure device.

9. A cleaning body comprising:

a shaft;

a cleaning member that is spirally wound around the shaft, and that has an elastic layer and an adhesive layer whose obverse is adhered to the elastic layer and whose reverse is adhered to the shaft; and a pressing member that is provided on at least one end portion in an axial direction of the shaft, and that provides a contacting surface, and that presses the elastic layer between the shaft and an inner circumferential surface of the pressing member that is formed along a circumferential direction of the shaft, wherein the adhesive layer is bent in a radial direction of the shaft along the contacting surface and adheres to the contacting surface, and wherein the adhesive layer is bent in the radial direction of the shaft along the contacting member and a radial side of the elastic layer.

10. The cleaning body of claim 9, wherein the contacting surface includes an inner wall surface of the pressing member, which inner wall surface is formed substantially perpendicular to the axial direction.

11. The cleaning body of claim 9, wherein the contacting surface includes the inner circumferential surface of the pressing member.

12. A cleaning body comprising:

a shaft;

a cleaning member that is spirally wound around the shaft, and that has an elastic layer and an adhesive layer whose obverse is adhered to the elastic layer and whose reverse is adhered to the shaft; and a pressing member that is provided on at least one end portion in an axial direction of the shaft, and that provides a contacting surface that contacts the adhesive layer at a position away from an circumferential surface of the shaft, and that presses the elastic layer between the shaft and an inner circumferential surface of the pressing member that is formed along a circumferential direction of the shaft, wherein the contacting surface includes the inner circumferential surface of the pressing member, and the inner circumferential surface has a first inner portion, and a second inner portion that is disposed further toward an axial direction central side of the shaft than the first inner portion and whose inner diameter is larger than an inner diameter of the first inner portion.

13. The cleaning body of claim 12, wherein a cut-out portion that exposes the elastic layer is formed in the second inner portion.

14. The cleaning body of claim 1, wherein the adhesive layer adheres the side of the elastic layer to the contacting member in the radial direction.

15. The cleaning body of claim 9, wherein the adhesive layer adheres the side of the elastic layer to the contacting member in the radial direction.

* * * * *